United States Patent [19]

Railescu

[11] Patent Number: 5,031,866

[45] Date of Patent: Jul. 16, 1991

[54] MODULAR DISPLAY STAND

[75] Inventor: Cristian Railescu, Calgary, Canada

[73] Assignee: Mayalta Corporation, Calgary, Canada

[21] Appl. No.: 486,130

[22] Filed: Feb. 28, 1990

[51] Int. Cl.[5] ..... F16M 11/32

[52] U.S. Cl. ..... 248/165; D6/405; 211/189

[58] Field of Search ..... 248/165, 150, 174, 166, 248/688, 151, 176, 431; 108/153; 52/648; D6/403, 405; 211/189

[56] References Cited

U.S. PATENT DOCUMENTS

| | | | |
|---|---|---|---|
| D. 254,886 | 5/1980 | Haines | D6/405 |
| D. 271,730 | 12/1983 | Wall | D6/405 |
| 2,048,608 | 7/1936 | Holland | 248/150 |
| 3,366,079 | 1/1968 | Koransky et al. | 248/431 X |
| 4,825,781 | 5/1989 | Palmer | 108/153 |

*Primary Examiner*—Ramon O. Ramirez

*Attorney, Agent, or Firm*—Renner, Kenner, Greive, Bobak, Taylor & Weber

[57] ABSTRACT

A modular stand for displaying plants and the like is made of a multiple of indentical c-shaped elements, which fit together to form a tripodal stand.

4 Claims, 2 Drawing Sheets

MODULAR DISPLAY STAND

FIELD OF THE INVENTION

This application relates to a modular stand for plants and other items that one may wish to display.

BACKGROUND OF THE INVENTION

Many forms of display stands for plants and other items are known. At the simplest level, a plant may be placed on the floor or on a table. For many plants, shelves can be used, and the plants lined up on the shelves.

In retail plant stores it is helpful if the stand can display individual plants to their best advantage. Generally, a display in a row, as on a shelf, will tend to diffuse the attention of a potential customer from a particular plant to the group of plants. The alternative, though, of vertical stacking as by stacking tables is not ideal, as the plants on the lower portions of the stack will tend to be overlooked by a potential purchaser.

Another constraint on the design of plant stands is the retail floor space that is available for these stands. This space may be limited and expensive and therefore it is desirable to maximize the number of plants which may be displayed within a relatively small floor area, while at the same time permitting a consumers attention to be focused on individual plants.

The above comments relate not only to plants, but also to other articles which it may be desired to sell. With plants, though, there is the additional factor that it is generally desirable to arrange the plant display so as to permit a large amount of light to hit the plants, and thus keep them healthy for an optimal period of time.

In the manufacture of stands, it is of assistance if the stand can be made of parts which are identical, thus minimizing the expense of creating molds and drawings for each individual part. Therefore, a modular construction is desirable.

SUMMARY OF THE INVENTION

This invention provides a tripodal, stackable stand constructed of three substantially identical c-shaped modular elements, each element having a bottom foot, a riser with attachment means and a cantilevered support surface. The modular elements may be attached to each other by the attachment means to form a tripodal stand, which stands may be stacked on each other.

A BRIEF DESCRIPTION OF THE DRAWINGS

DETAILED DESCRIPTION OF EMBODIMENT SHOWN

Figure 1:
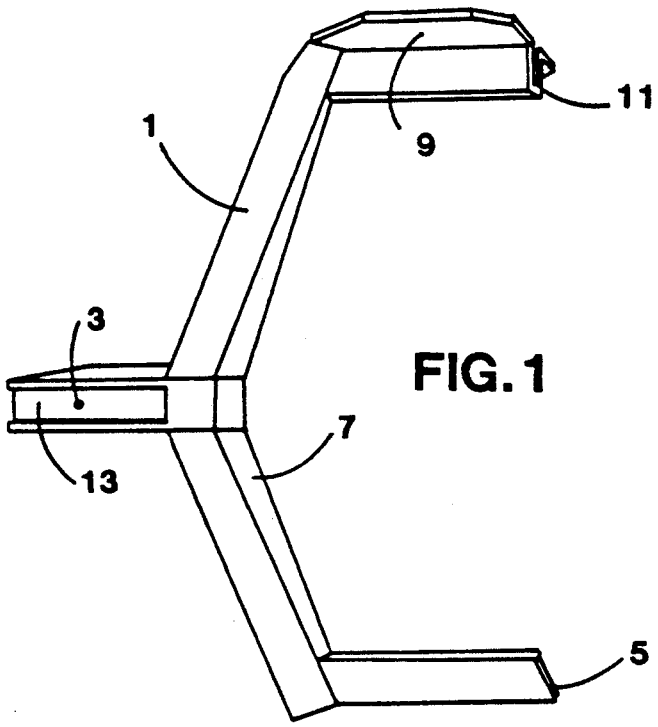
FIG. 1 shows a side view of a fully assembled stand.
Figure 2:
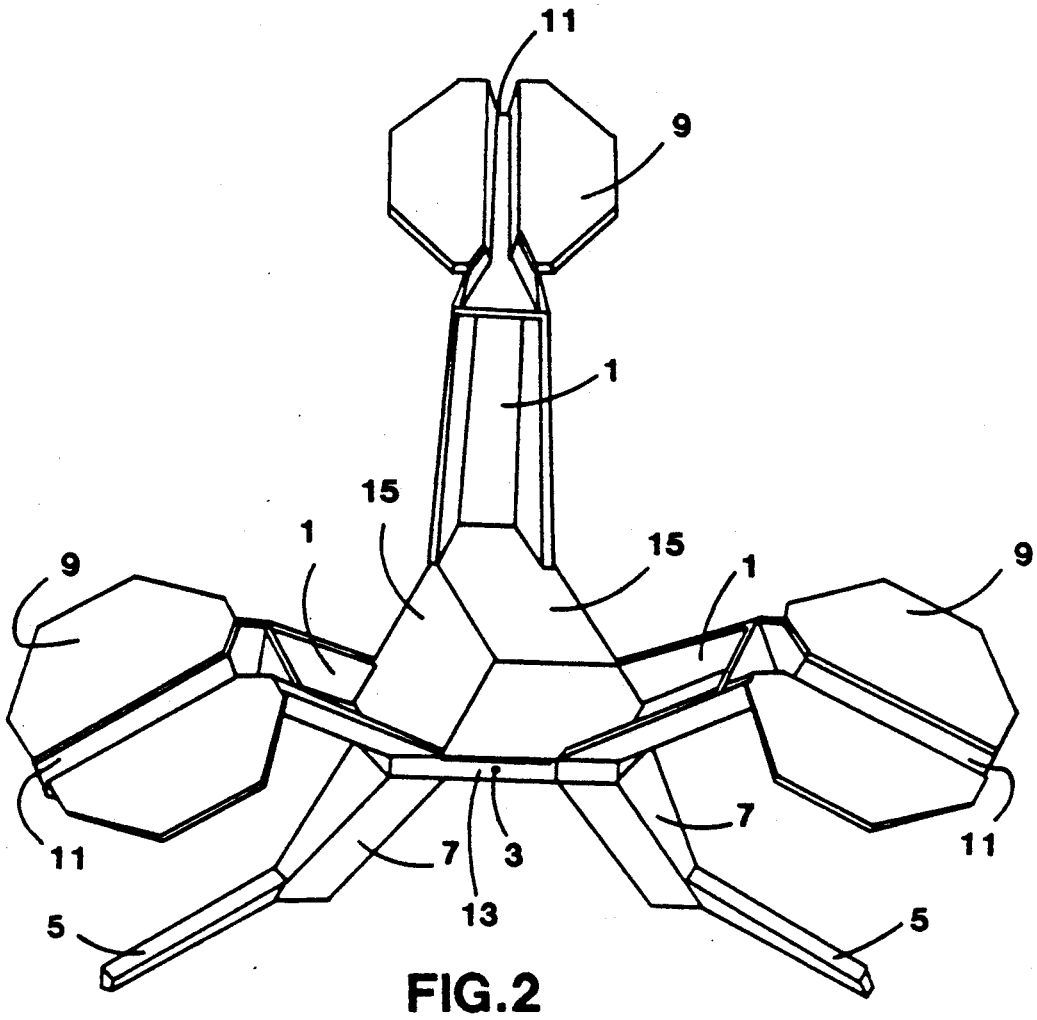
FIG. 2 shows a side view of an individual modular element of a stand.
Figure 3:
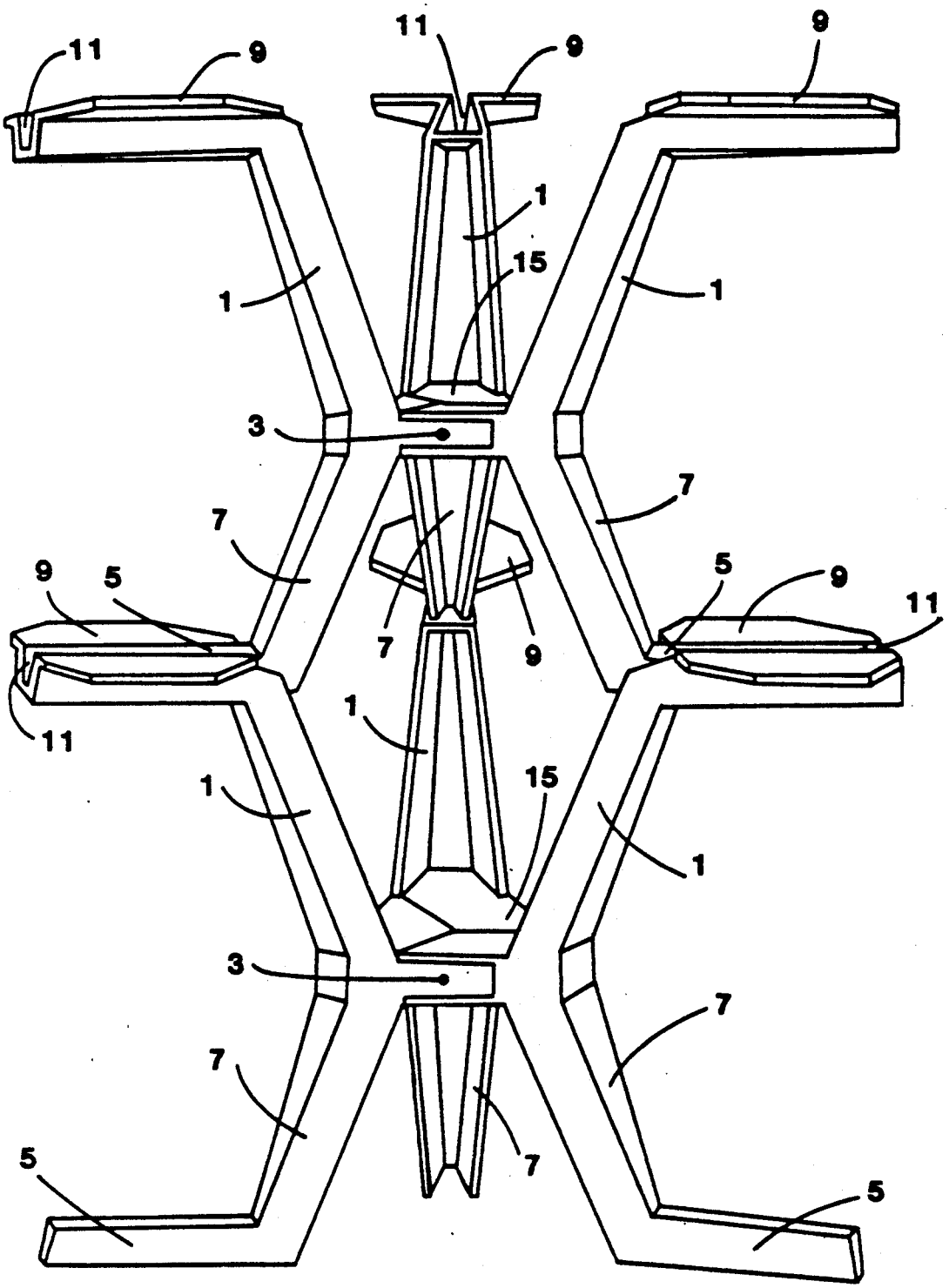
FIG. 3 shows a side view of a stacked assembly of two fully assembled stands.

The stand shown in the drawings is made of three identical modular elements 1 held together by bolts 3. Referring to FIG. 1, the modular elements are essentially c-shaped, having a bottom foot 5, a riser 7, and a cantilevered support surface 9. The bottom foot is v-shaped in cross section and thus fits into a v-shaped cut 11 in the support surface. Referring to FIG. 2, the modular elements may be bolted together through attachment means consisting of a tab 13 to form a stand, having three feet; that is, tripodal. These stands may then be stacked one on top of the other to provide a display as shown in FIG. 3.

When the modular elements are joined together, it will be seen that each group of three elements provides four support surfaces on which to display plants or the like. Three of these surfaces are the cantilevered portions of the modular elements 9, the fourth is formed by the three tabs on the modular elements 15. Two assembled stands, stacked one on top of the other will thus provide eight surfaces on which to display plants.

The cantilevered, c-shape of the modular elements permits the crown of the plant to spread.

The size of the modular elements may of course be varied, depending on the size of the pot and the plant which is to be displayed. In addition, different methods of attachment of the modules, and different designs of the foot and support surface can be used.

When the stand is assembled, it will be seen that it takes up a very small amount of floor space, and yet permits the display of several plants separately, and to good advantage.

I claim:

1. A stackable, tripodal stand comprising three substantially identical c-shaped modular elements attached to each other through attaching means and having a bottom foot, a riser bearing the attaching means and a cantilevered support surface, in which the attaching means when attached form a platform.

2. A stand as claimed in claim 1 whereby the support surface of one element is adapted to receive the foot of another element.

3. A stand as claimed in claim 2 made of lightweight, durable plastic.

4. A system comprised of a plurality of stands as described in claim 3, stacked on each other.

* * * * *